US008730283B2

(12) United States Patent
Meier et al.

(10) Patent No.: US 8,730,283 B2
(45) Date of Patent: May 20, 2014

(54) CREDENTIAL SUBSTRATE FEEDING IN A CREDENTIAL PROCESSING DEVICE

(75) Inventors: James R. Meier, Minneapolis, MN (US); John P. Skoglund, Minneapolis, MN (US)

(73) Assignee: Assa Abloy AB, Stockholm (SE)

( * ) Notice: Subject to any disclaimer, the term of this patent is extended or adjusted under 35 U.S.C. 154(b) by 131 days.

(21) Appl. No.: 13/496,403

(22) PCT Filed: Sep. 17, 2010

(86) PCT No.: PCT/US2010/049272

§ 371 (c)(1), (2), (4) Date: Mar. 15, 2012

(87) PCT Pub. No.: WO2011/035117

PCT Pub. Date: Mar. 24, 2011

(65) Prior Publication Data

US 2012/0169821 A1 Jul. 5, 2012

Related U.S. Application Data

(60) Provisional application No. 61/243,670, filed on Sep. 18, 2009.

(51) Int. Cl.
*B41J 2/00* (2006.01)
*B65H 5/22* (2006.01)

(52) U.S. Cl.
USPC ..... 347/110; 271/3.14

(58) Field of Classification Search
CPC .... B41J 2202/31; B41J 25/308; B41J 25/304; B41J 25/3082; B41J 25/3086; B41J 25/3088
USPC ..... 347/176, 174, 110, 171; 271/166, 137, 271/3.14, 115, 121, 124, 225; 400/58, 223, 400/191, 584
See application file for complete search history.

(56) References Cited

U.S. PATENT DOCUMENTS 2,401,719 A 6/1946 Braun
3,513,957 A 5/1970 Ricciardi et al.

(Continued)

FOREIGN PATENT DOCUMENTS

EP 1486342 A1 12/2004
JP 1268457 10/1989

(Continued)

OTHER PUBLICATIONS

Communication pursuant to Rules 161(1) and 162 EPC from corresponding European Patent Application No. 10771230.9, mailed Apr. 25, 2012.

(Continued)

*Primary Examiner* — Geoffrey Mruk
*Assistant Examiner* — Scott A Richmond
(74) *Attorney, Agent, or Firm* — Brian D. Kaul; Westman, Champlin & Koehler, P.A.

(57) ABSTRACT

Embodiments of the invention generally relate to credential processing devices and methods of feeding credential substrates in a credential processing device. One exemplary embodiment of the credential processing device includes a processing path, a print head, a transport mechanism, a first motor, a substrate input and an input feed mechanism. The print head is configured to print to a surface of a credential substrate that is fed along the processing path. The transport mechanism comprises one or more transport feed rollers that are configured to feed individual credential substrates along the processing path. The first motor is configured to drive the one or more transport feed rollers. The substrate input comprises an input feed roller configured to feed individual substrates from a supply to the transport mechanism. The input feed mechanism has an activated state, in which the input feed roller is mechanically coupled to the motor, and a deactivated state, in which the input feed roller is mechanically decoupled from the motor.

18 Claims, 8 Drawing Sheets

(56) References Cited

U.S. PATENT DOCUMENTS

| | | | | | |
|---|---|---|---|---|---|
| 3,623,933 | A | | 11/1971 | Staats | |
| 3,731,781 | A | | 5/1973 | Caudill et al. | |
| 3,933,350 | A | | 1/1976 | Mignano | |
| 3,948,506 | A | | 4/1976 | Crimmins et al. | |
| 3,961,785 | A | | 6/1976 | Gall | |
| 3,975,010 | A | | 8/1976 | Schisselbauer et al. | |
| 4,060,441 | A | | 11/1977 | Ohta et al. | |
| 4,276,112 | A | | 6/1981 | French et al. | |
| 4,299,504 | A | | 11/1981 | Benz et al. | |
| 4,305,577 | A | | 12/1981 | Clay et al. | |
| 4,387,000 | A | | 6/1983 | Tancredi | |
| 4,458,890 | A | | 7/1984 | Kawazu | |
| 4,527,149 | A | | 7/1985 | Swenson | |
| 4,568,074 | A | | 2/1986 | Murayoshi | |
| 4,590,486 | A | | 5/1986 | Yana | |
| 4,592,634 | A | | 6/1986 | Koch | |
| 4,607,832 | A | | 8/1986 | Abe | |
| 4,609,298 | A | | 9/1986 | Shioda | |
| 4,615,628 | A | | 10/1986 | Swinburne | |
| 4,619,728 | A | | 10/1986 | Brink | |
| 4,685,815 | A | | 8/1987 | Baranyi | |
| 4,869,455 | A | | 9/1989 | Weeks | |
| 4,878,773 | A | | 11/1989 | Mazumder | |
| 4,924,240 | A | | 5/1990 | Herbert et al. | |
| 4,938,616 | A | | 7/1990 | Shiozaki et al. | |
| 4,990,008 | A | | 2/1991 | Hwang | |
| 5,004,218 | A | | 4/1991 | Sardano et al. | |
| 5,037,216 | A | | 8/1991 | Nubson et al. | |
| 5,044,801 | A | | 9/1991 | Uchimura et al. | |
| 5,050,852 | A | | 9/1991 | Sawada et al. | |
| 5,064,301 | A | | 11/1991 | Nakamura et al. | |
| 5,102,116 | A | | 4/1992 | Garavuso | |
| 5,220,343 | A | | 6/1993 | Takanashi et al. | |
| 5,220,355 | A | | 6/1993 | Miyawaki | |
| 5,229,586 | A | | 7/1993 | Ishii | |
| 5,268,705 | A | | 12/1993 | Dreinhoff et al. | |
| 5,294,203 | A | | 3/1994 | Williams | |
| 5,301,834 | A | | 4/1994 | Lee et al. | |
| 5,366,306 | A | | 11/1994 | Mizutani et al. | |
| 5,368,677 | A | | 11/1994 | Ueda et al. | |
| 5,453,852 | A | * | 9/1995 | Morikawa et al. | 358/498 |
| 5,480,509 | A | | 1/1996 | Matsuo et al. | |
| 5,491,504 | A | * | 2/1996 | Grellman | 347/176 |
| 5,519,429 | A | | 5/1996 | Zwijsen et al. | |
| 5,546,115 | A | | 8/1996 | Nardone et al. | |
| 5,547,298 | A | | 8/1996 | Wouters et al. | |
| 5,554,250 | A | | 9/1996 | Dais et al. | |
| 5,558,449 | A | | 9/1996 | Morgavi | |
| 5,584,589 | A | * | 12/1996 | Adkins et al. | 400/584 |
| 5,584,962 | A | | 12/1996 | Bradshaw et al. | |
| 5,594,487 | A | | 1/1997 | Nuita et al. | |
| 5,597,248 | A | | 1/1997 | Burgin | |
| 5,600,362 | A | | 2/1997 | Morgavi et al. | |
| 5,669,724 | A | | 9/1997 | Kato | |
| 5,674,013 | A | | 10/1997 | Koike et al. | |
| 5,739,835 | A | | 4/1998 | Morgavi et al. | |
| 5,762,431 | A | | 6/1998 | Pawelka et al. | |
| 5,769,548 | A | | 6/1998 | Thompson et al. | |
| 5,783,024 | A | | 7/1998 | Forkert | |
| 5,820,277 | A | | 10/1998 | Schulte | |
| 5,825,392 | A | | 10/1998 | Mochizuki | |
| 5,829,631 | A | | 11/1998 | Kasper | |
| 5,895,157 | A | | 4/1999 | Morimura et al. | |
| 5,936,646 | A | | 8/1999 | Kenny et al. | |
| 5,941,522 | A | * | 8/1999 | Hagstrom et al. | 271/225 |
| 6,010,258 | A | | 1/2000 | Tomita et al. | |
| 6,069,642 | A | | 5/2000 | Isobe | |
| 6,094,209 | A | | 7/2000 | Nardone et al. | |
| 6,095,220 | A | * | 8/2000 | Kobayashi et al. | 156/540 |
| 6,105,861 | A | | 8/2000 | Kuit | |
| 6,151,478 | A | | 11/2000 | Katsuta et al. | |
| 6,176,286 | B1 | | 1/2001 | Kitagawa et al. | |
| 6,261,012 | B1 | | 7/2001 | Haas et al. | |
| 6,325,607 | B1 | | 12/2001 | Atake | |
| 6,352,095 | B1 | | 3/2002 | Fulmer et al. | |
| 6,386,772 | B1 | | 5/2002 | Klinefelter et al. | |
| 6,390,697 | B1 | | 5/2002 | O'Mera et al. | |
| 6,422,554 | B1 | * | 7/2002 | Wuethrich et al. | 271/166 |
| 6,446,832 | B1 | | 9/2002 | Holec et al. | |
| 6,486,904 | B1 | | 11/2002 | Onozato et al. | |
| 6,550,761 | B1 | | 4/2003 | Chiang | |
| 6,554,512 | B2 | | 4/2003 | Heno et al. | |
| 6,604,876 | B2 | | 8/2003 | Bryant et al. | |
| 6,616,360 | B2 | | 9/2003 | Lehmkuhl | |
| 6,626,298 | B2 | | 9/2003 | Lax | |
| 6,626,594 | B1 | | 9/2003 | Lallemant | |
| 6,640,717 | B2 | | 11/2003 | Kosaka et al. | |
| 6,644,802 | B2 | | 11/2003 | Minowa | |
| 6,646,666 | B2 | | 11/2003 | Matsuoka | |
| 6,682,241 | B2 | | 1/2004 | Coons et al. | |
| 6,714,228 | B1 | | 3/2004 | Holland et al. | |
| 6,827,509 | B2 | | 12/2004 | Suden et al. | |
| 6,910,656 | B2 | | 6/2005 | Lysiak et al. | |
| 6,981,536 | B2 | | 1/2006 | Lien et al. | |
| 7,018,117 | B2 | | 3/2006 | Meier et al. | |
| 7,549,633 | B2 | | 6/2009 | Nishitani et al. | |
| 7,717,632 | B2 | | 5/2010 | Lien et al. | |
| 2001/0046401 | A1 | | 11/2001 | Lien et al. | |
| 2001/0053947 | A1 | | 12/2001 | Lenz et al. | |
| 2002/0088553 | A1 | | 7/2002 | Whitby | |
| 2002/0158399 | A1 | * | 10/2002 | Heno et al. | 271/3.14 |
| 2003/0025781 | A1 | | 2/2003 | Honma et al. | |
| 2004/0071487 | A1 | | 4/2004 | Ono et al. | |
| 2004/0075730 | A1 | * | 4/2004 | Tsuruta | 347/171 |
| 2004/0109715 | A1 | | 6/2004 | Meier et al. | |
| 2004/0114981 | A1 | | 6/2004 | Meier et al. | |
| 2005/0078998 | A1 | | 4/2005 | Lien et al. | |
| 2005/0095049 | A1 | | 5/2005 | Yoshida et al. | |
| 2005/0242487 | A1 | | 11/2005 | Pelletier et al. | |
| 2006/0151935 | A1 | | 7/2006 | Liatard et al. | |
| 2008/0219735 | A1 | | 9/2008 | Hoffman | |

FOREIGN PATENT DOCUMENTS

| | | | |
|---|---|---|---|
| JP | 07039644 | | 2/1995 |
| JP | 11300830 | | 11/1999 |
| WO | 9619355 | A1 | 6/1996 |
| WO | 02/087891 | | 11/2002 |
| WO | 02/087892 | | 11/2002 |
| WO | 2005096724 | A2 | 10/2005 |

OTHER PUBLICATIONS

Machine translation of JP 07-39644 to Takase et al. from Japanese Patent Office website, Feb. 1995.

International Search Report and Written Opinion from PCT/US2010/049272, mailed Jan. 4, 2011.

First Office Action from Chinese Patent Application No. 201080041349X, dated Nov. 4, 2013.

* cited by examiner

CREDENTIAL SUBSTRATE FEEDING IN A CREDENTIAL PROCESSING DEVICE

CROSS-REFERENCE TO RELATED APPLICATION

This Application is a Section 371 National Stage Application of International Application No. PCT/US2010/049272, filed Sep. 17, 2010 and published as WO 2011/035117 A1 on Mar. 24, 2011, and claims the benefit of U.S. Provisional Application Ser. No. 61/243,670, filed Sep. 18, 2009 under 35 U.S.C. §119(e). Each of the above-referenced applications are incorporated herein by reference in their entirety.

Credentials include identification cards, driver's licenses, passports, and other documents. Such credentials are formed from credential or card substrates including paper substrates, plastic substrates, cards and other materials. Such credentials generally include printed information, such as a photo, account numbers, identification numbers, and other personal information. A secure overlaminate may also be laminated to the surfaces of the credential substrate to protect the surfaces from damage and, in some instances, provide a security feature (e.g., hologram). Additionally, credentials can include data that is encoded in a smartcard chip, a magnetic stripe, or a barcode, for example.

Such credentials are generally formed using a credential processing device that processes a credential substrate to produce the credential. Such processes generally include a printing process, a laminating process, a data reading process, a data writing process, and/or other process used to form the desired credential. These processes are performed by processing components of the device, such as a print head, a laminating roller, a data encoder (e.g., smart card encoder, magnetic stripe encoder, etc.) or other processing component that are in line with a processing path, along which individual card substrates are fed by a transport mechanism.

The transport mechanism generally includes feed rollers or pinch roller pairs that receive individual substrates from a substrate supply and feed the substrates along the processing path. The substrate supply generally includes a separate motorized feed mechanism that feeds individual substrates from, for example, a stack of substrates, to the feed rollers of the transport mechanism.

SUMMARY

Embodiments of the invention generally relate to credential processing devices and methods of feeding credential substrates in a credential processing device. One exemplary embodiment of the credential processing device includes a processing path, a print head, a transport mechanism, a first motor, a substrate input and an input feed mechanism. The print head is configured to print to a surface of a credential substrate that is fed along the processing path. The transport mechanism comprises one or more transport feed rollers that are configured to feed individual credential substrates along the processing path. The first motor is configured to drive the one or more transport feed rollers. The substrate input comprises an input feed roller configured to feed individual substrates from a supply to the transport mechanism. The input feed mechanism has an activated state, in which the input feed roller is mechanically coupled to the motor, and a deactivated state, in which the input feed roller is mechanically decoupled from the motor.

In accordance with another exemplary embodiment, the credential processing device comprises a feed motor, a platen, a print head, a head lift assembly, a substrate input and an input feed mechanism. The print head is configured to print to a surface of a credential substrate fed along a processing path between the platen and the print head. The head lift assembly is configured to move the print head relative to the print platen. The substrate input comprises an input feed roller. The input feed mechanism has an activated state, in which the input feed roller is driven by the feed motor, and a deactivated state in which the input feed roller is not driven by the feed motor. The activated and deactivated states of the input feed roller are set responsive to a position of the print head relative to the platen.

In one exemplary method of controlling credential substrate feeding in a credential processing device a credential processing device is provided. In one embodiment, the credential processing device comprises a feed motor, a platen, a print head, a head lift assembly and a substrate input. The print head is configured to print to a surface of the credential substrate fed along a processing path between the platen and the print head. The head lift assembly is configured to move the print head relative to the print platen. The substrate input comprises an input feed roller configured to feed individual credential substrates from a credential substrate supply. Also in the method, the print head is placed in a first position relative to the platen using the head lift assembly and rotation of the input feed roller is driven using the feed motor responsive to placing the print head in the first position. The print head is placed in a second position relative to the platen using the head lift assembly and the driving of rotation of the input feed roller using the feed motor is prevented responsive to placing the print head in the second position.

Other features and benefits that characterize embodiments of the invention will be apparent upon reading the following detailed description and review of the associated drawings.

DETAILED DESCRIPTION

Figure 1:
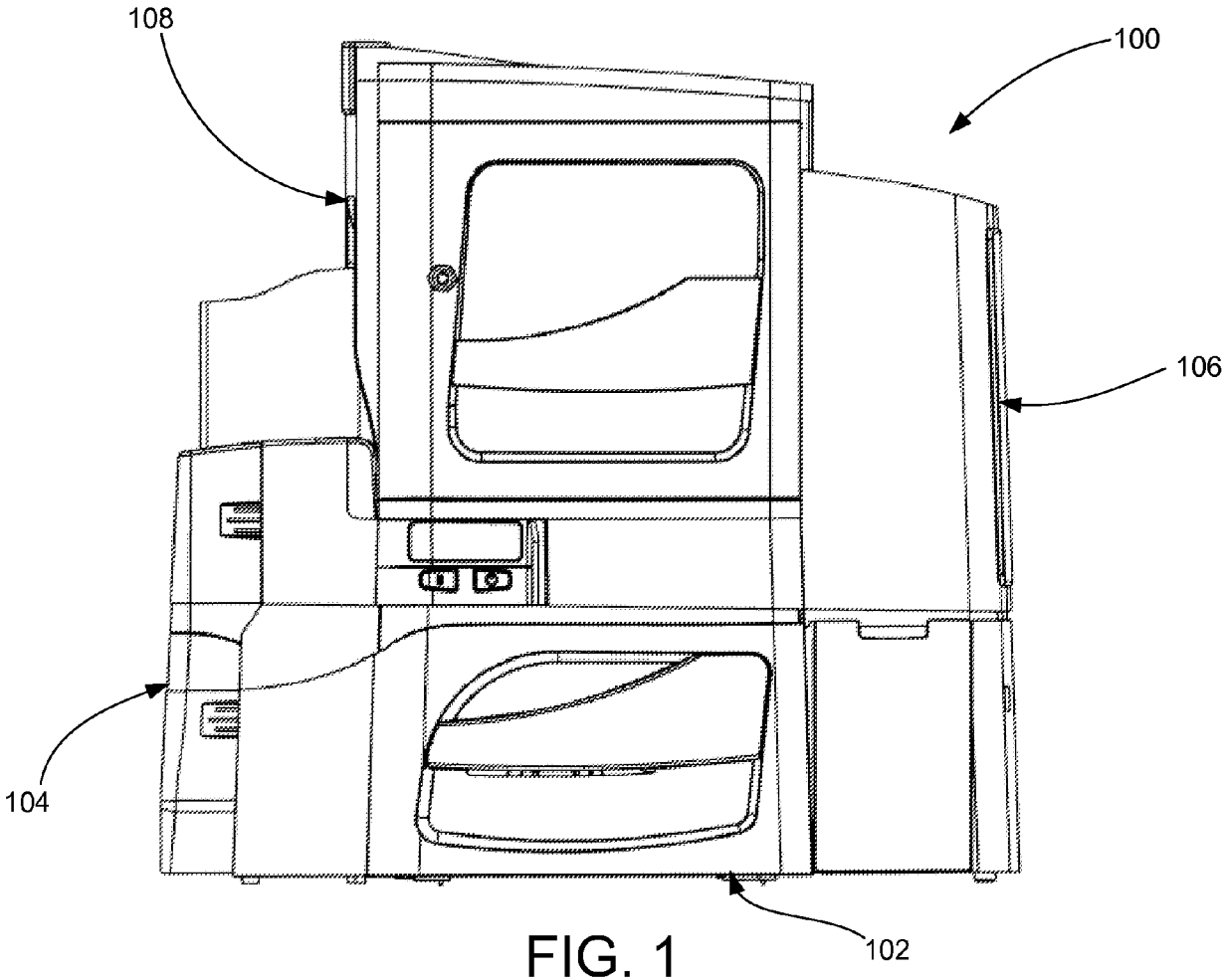
FIG. 1 illustrates a front elevation view of a credential processing device in accordance with embodiments of the invention.

FIG. 1 illustrates a front elevation view of an exemplary credential processing device 100 that is configured to process individual credential substrates, in accordance with embodiments of the invention. Embodiments of credential substrates include card substrates used to form identification cards.

Other embodiments of the card substrates include overlaminate substrates, passport substrates and other substrates used to form credentials.

In one embodiment, the credential processing device 100 includes a print section 102 configured to print an image and/or text to a credential substrate. Additional embodiments of the credential processing device 100 include a substrate input hopper section 104 configured to hold one or more card substrates for feeding to the print section 102, a card flipper or rotator section 106 configured to invert a card substrate to allow for processing of both sides of the substrate, and/or a laminating section 108 configured to apply an overlaminate to a surface of the card substrate.

Figure 2:
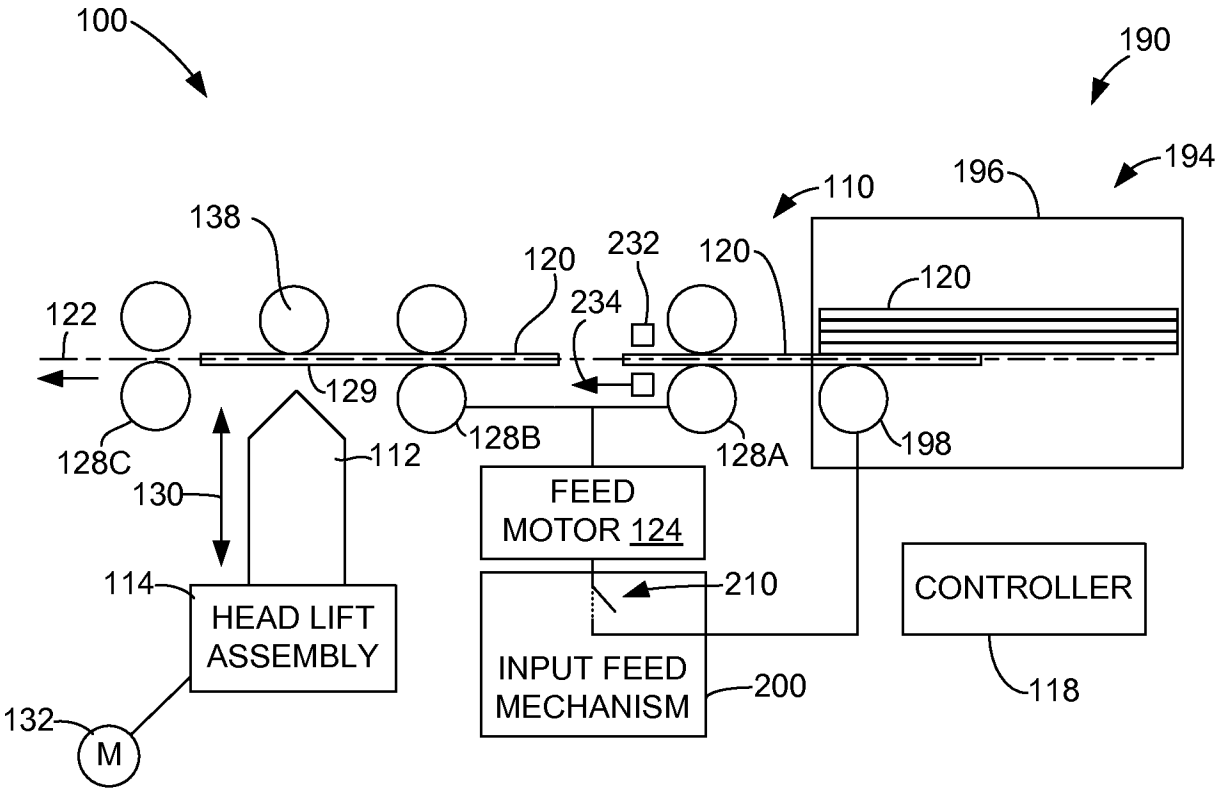
FIG. 2 is a schematic diagram of a credential processing device in accordance with embodiments of the invention.

FIG. 2 is a schematic diagram of the device 100 in accordance with embodiments of the invention. Embodiments of the device 100 include a substrate transport mechanism 110, a print head 112, a print head lift assembly 114 and a controller 118. The controller 118 generally processes credential production jobs from, for example, a host computer (not shown), that define the processes to be performed on an individual card substrate 120 to form the desired credential product. The controller 118 represents the memory, one or more microprocessors and other conventional components used to control the print head 112, motors, and other components of the device 100, to process the credential production jobs.

The substrate transport mechanism 110 is configured to transport a credential substrate 120 along a processing path 122. In one exemplary embodiment, the substrate transport mechanism 110 comprises a substrate feed motor 124 that drives one or more feed rollers or pinch roller pairs 128, such as feed rollers 128A-C, that feed the substrate 120 along the path 122.

The print head 112 is configured to print an image containing graphics and/or text directly to a surface 129 of the card substrate 120 that is fed along the path 122. Exemplary embodiments of the print head 112 include a thermal print head that uses a print ribbon, and an ink jet print head.

Figure 3:
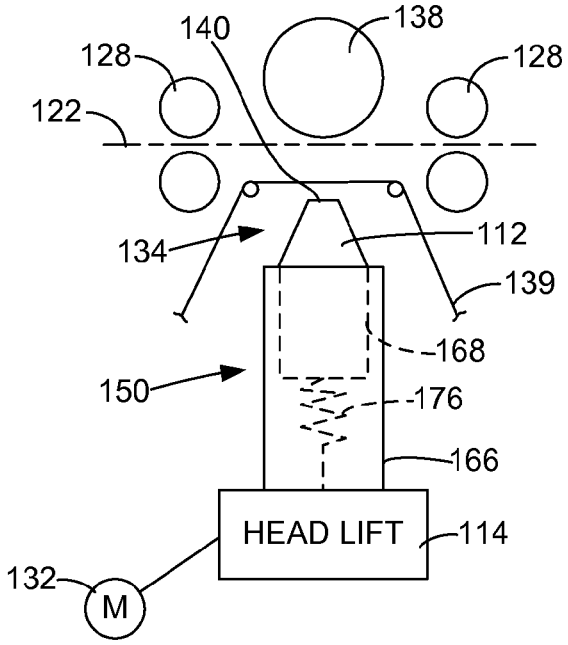
FIGS. 3-5 are simplified illustrations of positions of a print head determined by a head lift assembly, in accordance with embodiments of the invention.
Figure 4:
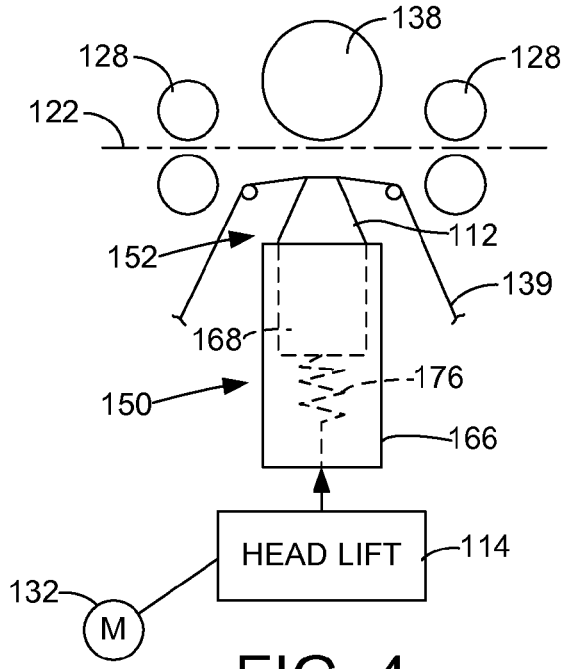
Figure 5:
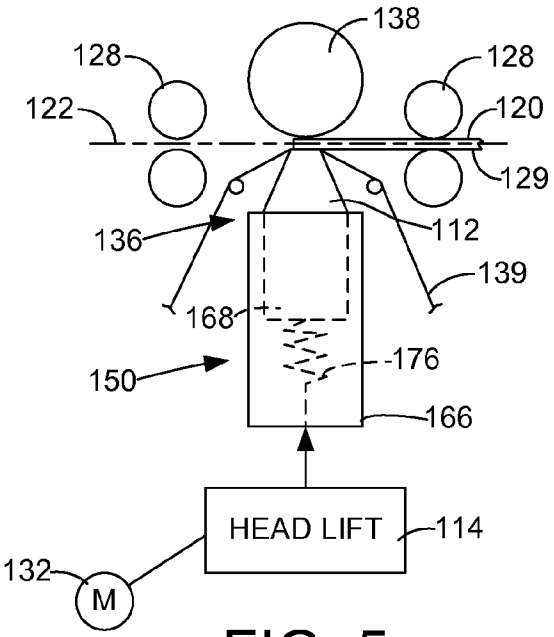

The print head lift assembly 114 is configured to move the print head 112 relative to the path 120 as indicated by arrow 130. In one embodiment, this movement of the print head 112 is driven by a motor 132. In one embodiment, the motor 132 is a stepper motor. FIGS. 3-5 are simplified illustrations of positions of the print head 112 determined by the head lift assembly 114, in accordance with embodiments of the invention.

In one embodiment, the motor 132 drives the print head lift assembly 114 to move print head 112 into at least two predetermined positions: a full-down position 134 (FIG. 3) and a print position 136 (FIG. 5). In the full-down position 134, print head 112 is displaced from substrate transport path 122, as shown in FIG. 3.

Print operations on a surface 129 of the substrate 120 can occur when the print head 112 is in the print position 136, as indicated in FIG. 5. The motor 132 drives the print head lift assembly 114 to move the print head 112 toward a print platen 138 such that the print head 112 is in position to print an image to the surface 129 of the substrate 120.

In one embodiment, the print head 112 is a thermal print head that comprises heating elements 140 and utilizes the print ribbon 139 comprising panels of dye (e.g., cyan, magenta, etc.) to print images to the substrate 120. In one embodiment, the full-down position 134 allows the print ribbon 139 to be removed and loaded into the device 100, for example. When the print head 112 is in the print position 136, the print ribbon 139 and the substrate 120 are squeezed between the heating elements 140 and the platen 138. The heating elements 140 are selectively activated by the controller 118 to heat the dye of the ribbon 139 and transfer the dye to the surface 129 of the substrate 120 to print the desired image on the substrate 120.

In one embodiment, the pressure applied by the print head 112 against the substrate 120 is substantially constant due to a biasing mechanism 150. The biasing mechanism 150 operates to apply a biasing force to the print head 112 that directs the print head 112 toward the platen 138. As the print head 112 applies pressure to the substrate 120, the biasing force produced by the biasing component 150 is overcome and the print head 112 is moved to a floating position, in which the biasing mechanism 150 applies a substantially uniform pressure to the substrate 120 through the print head 112. This uniform pressure improves print image quality. In one embodiment, the biasing mechanism 150 comprises a spring or other equivalent element, as discussed below.

In one embodiment, the print head lift assembly 114 is configured to move the print head 112 to a cue position 152, shown in FIG. 4, which is a predetermined position that is intermediate the full-down position 134 and the print position 136. In one embodiment, the cue position 152 places the print head 112 in close proximity to the print ribbon 139 as the substrate 120 is moved close to the print head 112. In one embodiment, the cue position 152 positions the heating elements 140 in contact with the ribbon 139. In one embodiment, the cue position 152 causes the heating elements 140 to press against the ribbon 139 and move the ribbon 139 in close proximity to the processing path 122, preferably a distance from the platen 138 that is only slightly greater than the thickness of the substrate 120.

Figure 6:
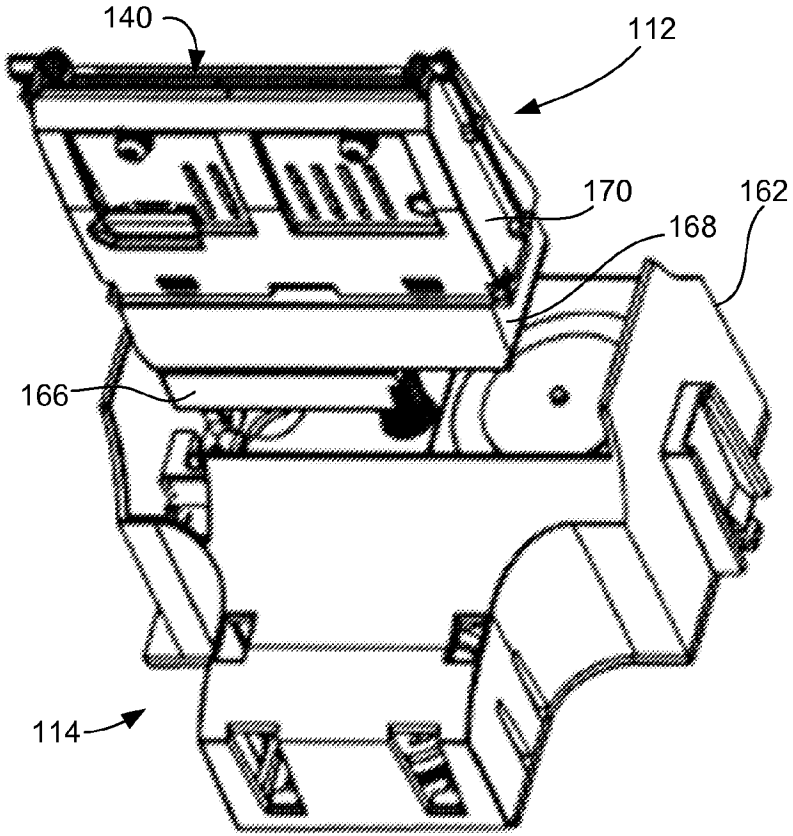
FIG. 6 illustrates an isometric view of a print head and print head lift system in accordance with embodiments of the invention.
Figure 7:
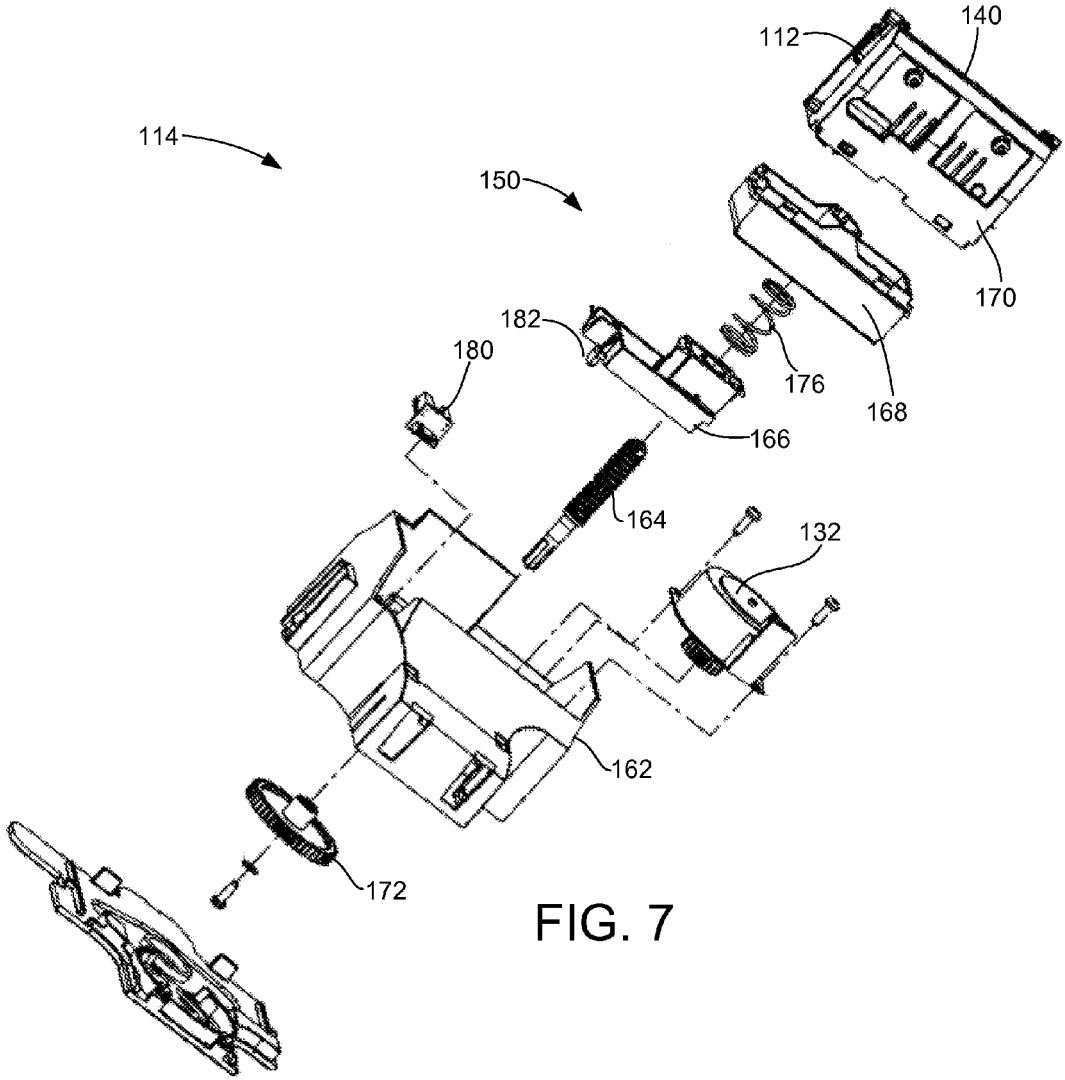
FIG. 7 illustrates an exploded isometric view of the print head and print head lift assembly of FIG. 3.
Figure 8:
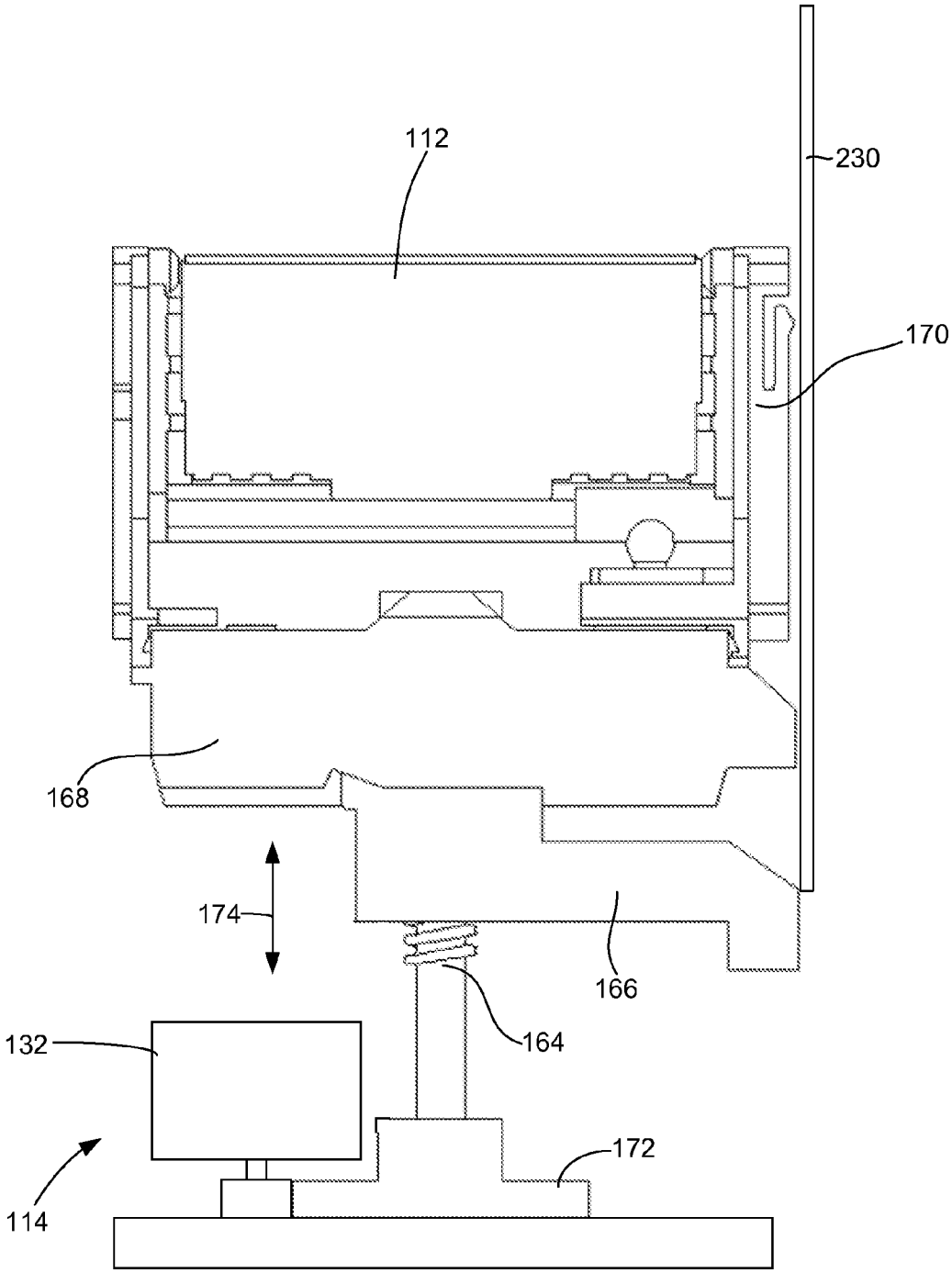
FIG. 8 illustrates a simplified front view of the print head and print head lift assembly of FIGS. 6 and 7.

A discussion of additional embodiments of print head lift assembly 114 will be provided with reference to FIGS. 6-8. FIG. 6 illustrates an isometric view of the print head 112 and the print head lift assembly 114 in accordance with embodiments of the invention. FIG. 7 illustrates an exploded isometric view of the print head 112 and the print head lift assembly 114 illustrated in FIG. 6. FIG. 8 illustrates a simplified diagram of the print head 112 and the print head lift assembly 114 of FIGS. 6 and 7.

Embodiments of the print head lift assembly 114 include the motor 132, a housing 162, a threaded shaft 164, a fixed threaded bracket 166, a spring loaded bracket 168 and/or a print head mount bracket 170. In one embodiment, the motor 132 is a stepper motor, as mentioned above. In one embodiment, the motor 132 drives a gear 172 that is attached to the threaded shaft 164. One advantage of using a stepper motor for motor 132 is that it can accurately rotate the shaft 164.

In one embodiment, the fixed threaded bracket 166 includes a threaded bore through which the threaded shaft 164 extends. The motor 132 is configured to rotate threaded shaft 164, which drives movement of fixed threaded bracket 166 either toward or away from processing path 122, as represented by arrow 174 in FIG. 8. The spring loaded bracket 168 is supported on the fixed threaded bracket 166.

In one embodiment, the biasing mechanism 150 comprises the bracket 168, the bracket 166 and a spring 176, which are illustrated in FIG. 7. In one embodiment, the bracket 168 can move relative to the bracket 166, but is biased in a forward position toward the path 122 by the spring 176. When the print head 112 begins to push against the substrate 120 and the print platen 138 (FIG. 5), the bias force produced by the spring 176 is overcome and the bracket 168 moves toward the bracket 166 to a floating position. For example, spring 176 can be compressed a distance ranging between approximately 0 and 0.250 inches. This compression range is what signifies the amount of adjustable print head force. The amount of print head force can be determined by the spring rate of the spring 176 and the distance of compression.

The motor 134, particularly its stepper motor form, can adjust the position of the bracket 166 relative to the platen 138 to adjust the print head force. In one embodiment, the print head force can be user-adjusted through a setting of the device 100 accessible by a user through, for example, software running on a host computer. This adjustability is useful in fine tuning the device for quality image printing, which may be necessary due to variable thicknesses of substrates 120. For instance, if the print head force excessively compresses the substrate 120 against the rubber exterior of the print platen 118, a portion of print ribbon 139 that extends outside the substrate 120 can catch on the platen 138 and drag. This results in light edge printing or edge wrinkle.

In one embodiment, the print head lift assembly 114 includes a sensor 180, shown in FIG. 7, that is used to detect the predetermined positions of print head 112, such as the full-down position 134, the print position 136 and/or the cue position 152. In one embodiment, the sensor 130 is attached to the housing 162 and detects a projection 182 of the fixed bracket 166, as shown in FIG. 7, to detect the various positions of print head 112. Other sensing schemes for detecting the position of the print head 112 may also be used.

One embodiment of device 100 comprises a substrate input 190 where individual substrates 120 are fed to the transport mechanism 110 for feeding along the processing path 122. One embodiment of the substrate input 190 comprises a supply 194 of one or more substrates 120. In one embodiment, the supply 194 comprises a hopper or cartridge 196 containing the substrate 120, as shown in FIG. 2. One embodiment of the substrate input 190 includes an input feed roller 198 that is configured to drive individual substrates 120 from the supply 194 to the transport mechanism 110. In one embodiment, the supply 194 of substrates 120 rest upon the top of the feed roller 198, as shown in FIG. 2. In one embodiment, the substrates 120 are located below the feed roller 198 and are spring-loaded against the bottom side of the feed roller 198.

In one embodiment, it is desirable to selectively activate (i.e., drive) the feed roller 198 and deactivate (i.e., stop driving) the feed roller 198 to control the feeding of individual substrates 120 to the transport mechanism 110 and to provide controlled spacing between the individual substrates 120 on the processing path 122. In one embodiment, the driving of the feed roller 198 is mechanically activated and deactivated using an input feed mechanism 200. In one embodiment, input feed mechanism 200 has an activated state, in which the feed roller 198 is mechanically coupled to the motor 124, and a deactivated state, in which the feed roller 198 is mechanically decoupled from the motor 124. In one embodiment, the input feed mechanism 200 and the input feed roller 198 are set in either the activated or deactivated state responsive to a position of the print head 112, or other component that moves with the print head 112, such as the bracket 136 or 138, for example, relative to the processing path 122 or the platen 138. That is, the input feed mechanism 200 and the input feed roller 198 are set to the activated state, in which the feed roller 198 is driven by the motor 124, when the print head 112 is in a first position relative to the processing path 122 or the platen 138, and the input feed mechanism 200 and the input feed roller 198 are set to the deactivated state, in which the feed roller 198 is not driven by the motor 124, when the print head 112 is in a second position relative to the processing path 122 or the platen 138.

Figure 9:
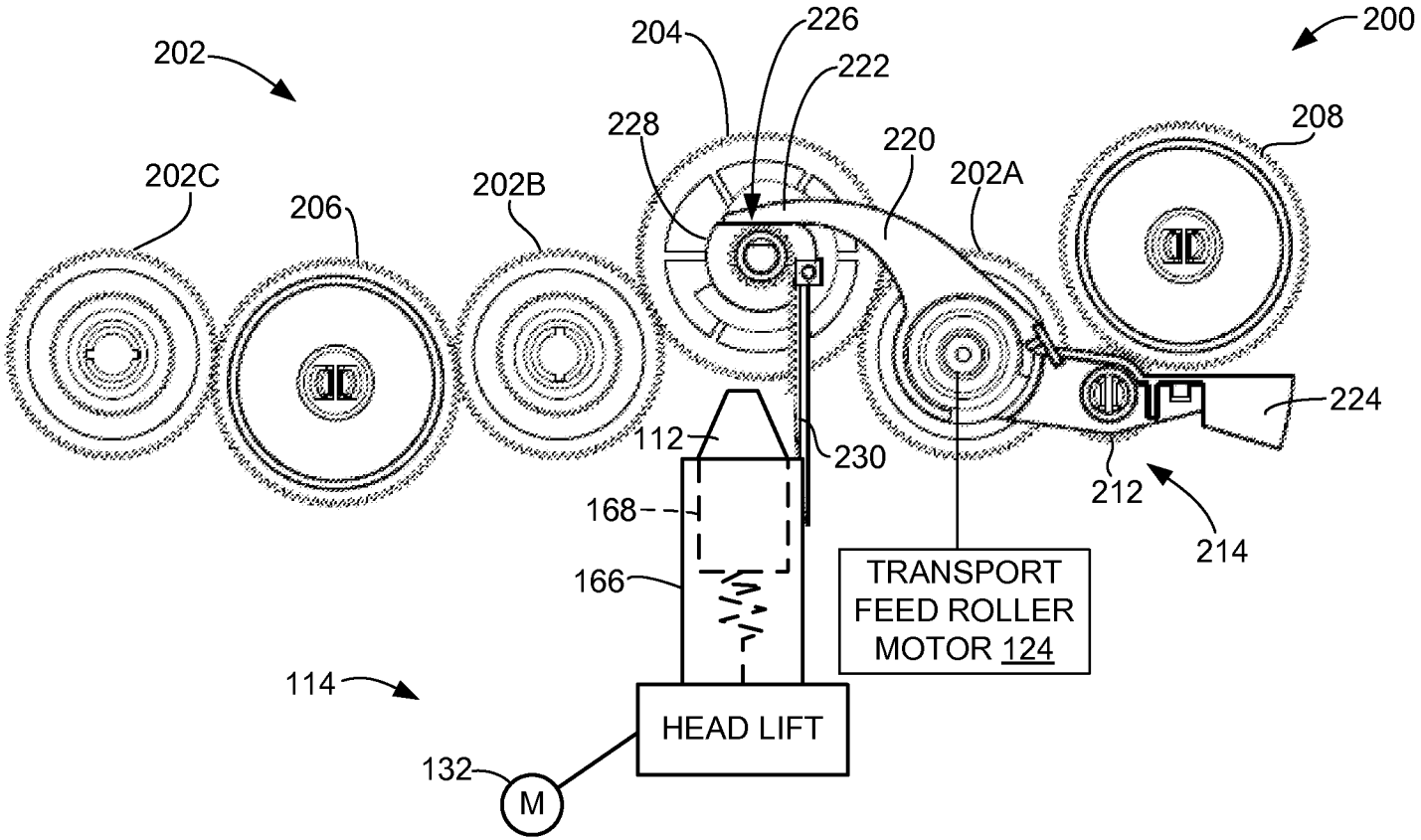
FIG. 9 illustrates a simplified diagram of an input feed mechanism in an engaged position in accordance with embodiments of the invention.
Figure 10:
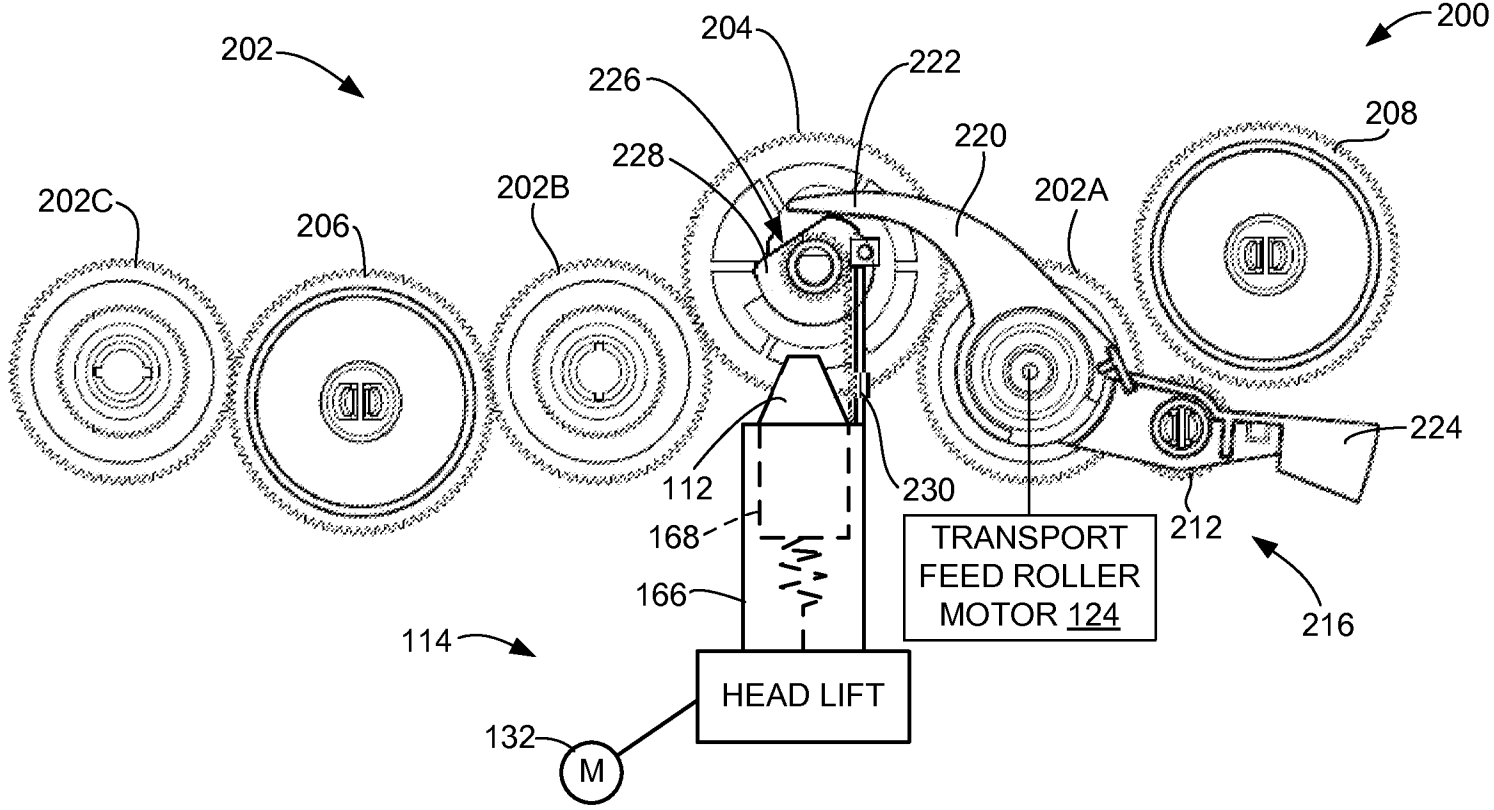
FIG. 10 illustrates a simplified diagram of the input feed mechanism illustrated in FIG. 9 in a disengaged position, in accordance with embodiments of the invention.

FIGS. 9 and 10 are simplified illustrations of the transport mechanism 110 and the input feed mechanism 200 in accordance with embodiments of the invention. As discussed above, the motor 124 of the transport mechanism 110 drives the rotation of one or more feed rollers or pinch roller pairs, generally designated 128 (FIG. 2), located along the processing path 122 of the device 100. In one embodiment, the motor 124 drives the rotation of the feed rollers 128 through a gear train 202, shown in FIGS. 9 and 10. In one embodiment, the motor 124 is configured to drive rotation of the feed roller 128A (FIG. 2) through the driving of a gear 202A of the gear train 202. One embodiment of the gear train 202 includes a gear 204 that engages the gear 202A and drives rotation of the platen 138. In one embodiment, the gear train 202 includes a gear 202B that engages the gear 204 and drives the rotation of the feed roller 128B. In one embodiment, the gear train 202 includes a gear 202C that engages the gear 202B through an intermediary gear 206. The gear 202C drives the rotation of the feed roller 128C.

One embodiment of the input feed mechanism 200 comprises at least one gear, such as gear 208, that drives rotation of the input feed roller 198 (FIG. 2). It is understood that the gear 208 may directly drive the rotation of the input feed roller 198, or the gear 208 may drive the rotation of the input feed roller 198 through one or more other gears (not shown).

In one embodiment, the gear 208 can be mechanically coupled to, and decoupled from, the gear train 202 and, thus, mechanically coupled to, and decoupled from, the motor 124 by the input feed mechanism 200, as represented by the switch 210 shown in FIG. 2. In one embodiment, the input feed mechanism 200 includes at least one movable gear having an activated position, in which the moveable gear engages the gear train 202 to mechanically couple the gear 208 and the feed roller 198 to the motor 124, and a deactivated position, in which the moveable gear is disengaged from the gear train 202 and/or the gear 208, to decouple the gear 208 and the feed roller 198 from the motor 124. In one embodiment, the position of the moveable gear between the activated and deactivated positions occurs in response to movement of the print head 112 by the head lift assembly 114.

In one exemplary embodiment, the input feed mechanism 200 includes a gear 212 that operates as the movable gear. The gear 212 moves between an activated position 214, shown in FIG. 9, in which the gear 212 engages the gear 202A of the gear train 202 and the gear 208. Thus, the gear 212 forms a link in a gear train from the motor 124 to the input feed roller 198. As a result, rotation of the gear 202A by the motor 124 drives the rotation of the gear 212 and the gear 208, which in turn drives the rotation of the feed roller 198. Thus, when the gear 212 is in the activated position 214, the motor 124 of the transport mechanism 110 is mechanically coupled to the input feed roller 198 through a gear train and drives the rotation of the input feed roller 198, which drives the feeding of a card substrate 120 from the supply 194, as illustrated in FIG. 2.

The gear 202 also includes a deactivated position 216, shown in FIG. 10, in which the gear 212 is disengaged from the gear 202A and/or gear 208. As a result, the gear 208 of the input feed mechanism 200 is mechanically decoupled from the gear train 202 and the motor 124 and the feed roller 198 is mechanically decoupled from the motor 124. Accordingly, individual substrates 120 are not fed from the supply 194 by the feed roller 198 to the feed rollers 128 of the transport mechanism 110 when the movable gear 212 is in the deactivated position 216.

One exemplary embodiment of the input feed mechanism 200 comprises a lever arm 220 that is pivoted responsive to movement of the print head 112 to move the movable gear (e.g., gear 212) between the activated and deactivated positions. In one exemplary embodiment, the lever arm 220 is configured to pivot about the axis of rotation of the gear 202A and comprises an arm 222 and an arm 224. The arm 222 engages a cam surface 226 of a cam 228. In one embodiment, the lever arm 220 is biased using a spring or other suitable mechanism to drive the arm 222 against the cam 228.

In one embodiment, the arm 224 supports the movable gear 212. In one embodiment, the movable gear 212 is supported by the second lever arm 224 in constant engagement with the gear 202A as the lever arm 220 pivots about the axis of rotation of the gear 202A.

The cam 228 is configured to rotate about the axis of gear 204 responsive to the position of the print head 112. In one embodiment, a push rod 230 is coupled to the cam 228 at one end and a component that is attached to the print head 112, such as the bracket 166 or 168, at the other end. The rod 230 drives the rotation of the cam 228 about the axis of rotation of gear 204 responsive to the raising and lowering of the print head 112 by the head lift assembly 114.

In one embodiment, when the head lift assembly 114 is in the full-down position 134 (FIG. 3), the angular position of the cam 228 is such that the arm 222 is in a lowered position, which places the movable gear 212 supported by the arm 224 in the activated position 214 and in engagement with the gear 208, as shown in FIG. 9. Thus, in accordance with one embodiment, the input feed roller 198 is placed in the activated state, in which it is driven by the motor 124 of the transport mechanism 110, when the print head 112 is in the full-down position 134. In one embodiment, the motor 124 simultaneously drives the rotation of the feed rollers 128 of the transport mechanism 110 when the print head 112 is in the full-down position 134.

In one embodiment, a sensor 232 (FIG. 2) detects the feeding of the substrate 120 along the processing path 122 and provides a signal 234 to the controller 118, which causes the motor 132 to drive the head lift assembly 114 and raise the print head 112 to the cue position 152 (FIG. 4). This movement of the print head 112 causes the rod 230 to drive rotation of the cam 228 about the axis of rotation of gear 204. The cam surface 226, against which the first lever arm 222 engages, drives the first lever arm 222 upward and pivots the lever arm 220 about the axis of rotation of the gear 202A to move the second lever arm 224 downward and cause the movable gear 212 to move to the deactivated state 216 and become disengaged from the gear 208 and/or gear 202A, as shown in FIG. 10. As a result, the gear 208 and the feed roller 198 become mechanically decoupled from the gear train 202 and the motor 124. The resultant deactivated state 216 of the feed roller 198 prevents the feeding of individual cards 120 from the supply 194 to the transport mechanism 110.

Thus, embodiments of the invention include the transitioning of the feed roller 198 from the activated state 214 to the deactivated state 216 as the print head 112 is moved toward the processing path 122 or the platen 138. Thus, while the exemplary embodiments described above specifically describe the switching of the feed roller 198 from the activated state to the deactivated state as the print head 112 is moved from the full-down position 134 to the cue position 152, it is understood that the transition from the activated state to the deactivated state for the feed roller 198 may occur at other positions of the print head 112 relative to the processing path 122.

In one embodiment, the feed roller 198 remains in the deactivated state as the print head 112 is moved from the cue position 152 (FIG. 4) to the print position 136 (FIG. 5) by the head lift assembly 114. The controller 118 then controls the print head 112 to print an image to a surface 129 of the substrate 120. After completion of the printing step, the controller 118 directs the print head 112 to the full-down position 134 using the head lift assembly 114. The input feed mechanism 200 then returns to the state illustrated in FIG. 9, which activates the feed roller 198 to drive the feeding of another substrate 120 from the supply 194 to the feed rollers 128 of the transport mechanism 110 to feed the substrate 120 along the processing path 122 for processing.

Embodiments of the input feed mechanism 200 described above eliminate the need for a separate drive motor for the input feed roller 198. Thus, in one embodiment, the input feed mechanism 200 lacks a separate drive motor for driving the feeding of substrates 120 from the supply 194. Rather, the input feed roller 198 is selectively driven by the motor 124 that drives the feed rollers 128 of the transport mechanism 110.

Although the present invention has been described with reference to preferred embodiments, workers skilled in the art will recognize that changes may be made in form and detail without departing from the spirit and scope of the invention. For instance, although embodiments of the credential device are illustrated as performing a process (e.g., printing) on a bottom surface of a substrate, it is understood that the device can be configured to perform the process on a top surface of the substrate.

What is claimed is:

1. A credential processing device comprising:

a processing path;

a print head;

a head lift assembly configured to move the print head relative to the processing path;

a transport mechanism comprising one or more transport feed rollers configured to feed individual substrates along the processing path;

a first motor configured to drive the one or more transport feed rollers;

a substrate input comprising an input feed roller configured to feed the individual substrates from a supply to the transport mechanism; and an input feed mechanism comprising an activated state, in which the input feed roller is mechanically coupled to the first motor, and a deactivated state, in which the input feed roller is mechanically decoupled from the first motor;

wherein:

movement of the print head relative to the processing path mechanically drives the input feed mechanism between the activated and deactivated states; and the input feed mechanism is placed in the activated state responsive to the print head being in a first position relative to the processing path, and the input feed mechanism is placed in the deactivated state responsive to the print head being in a second position relative to the processing path.

2. The device of claim 1, wherein the head lift assembly comprises:

a threaded shaft;

a fixed bracket supporting the print head and coupled to the threaded shaft, the fixed bracket configured to move relative to the threaded shaft responsive to rotation of the threaded shaft; and a second motor configured to drive rotation of the threaded shaft.

3. The device of claim 2, wherein the print head is configured to move relative to the fixed bracket and is biased away from the fixed bracket.

4. The device of claim 3, wherein the print head lift assembly further comprises:

a spring bracket coupled to the print head; and a spring located between the fixed bracket and the spring bracket.

5. The device of claim 1, wherein:

the transport mechanism further comprises a first gear configured to drive rotation of one or more of the transport feed rollers of the transport mechanism;

the first motor drives rotation of the first gear; and the input feed mechanism comprises a second gear configured to drive rotation of the input feed roller and a movable gear having an activated position, in which the movable gear engages the first and second gears and mechanically couples the second gear and the feed roller to the first motor, and a deactivated position, in which the movable gear is disengaged from at least one of the first and second gears to decouple the second gear and the feed roller from the first motor.

6. The device of claim 5, wherein the input feed mechanism further comprises a lever arm having a first arm configured to move the movable gear between its activated and deactivated positions responsive to pivoting of the lever arm about an axis.

7. The device of claim 6, wherein movement of the print head relative to the processing path mechanically drives the lever arm to pivot about the axis.

8. The device of claim 7, further comprising a cam having a cam surface that engages a second arm of the lever arm, wherein movement of the print head relative to the processing path mechanically drives rotation of the cam, and the second arm pivots the lever arm about the axis responsive to the rotation of the cam.

9. The device of claim 5, wherein:

movement of the print head relative to the processing path mechanically drives the movable gear between the activated and deactivated positions;

the movable gear is placed in the activated position when the print head is in the first position; and the movable gear is placed in the deactivated position when the print head is in the second position.

10. The device of claim 9, wherein the print head is displaced a greater distance from the processing path when in the first position than when in the second position.

11. A credential processing device comprising:

a feed motor;

a platen;

a print head;

a head lift assembly configured to move the print head relative to the print platen;

a substrate input comprising an input feed roller; and an input feed mechanism comprising an activated state, in which the input feed roller is driven by the feed motor, and a deactivated state, in which the input feed roller is not driven by the feed motor;

wherein movement of the print head relative to the platen mechanically drives the input feed mechanism between the activated and deactivated states.

12. The device of claim 11, wherein the input feed mechanism comprises a mechanical gear train between the head lift assembly and the input feed roller, through which the activated and deactivated states are set.

13. The device of claim 11, wherein the input feed mechanism comprises a movable gear that forms a link in a gear train between the feed motor and the input feed roller when the input feed mechanism is in the activated state, and the movable gear disconnects from the gear train when the input feed mechanism is in the deactivated state.

14. The device of claim 11, wherein the print head has a first position relative to the platen in which the input feed roller is driven by the feed motor, and the print head has a second position relative to the platen, in which the input feed roller is not driven by the feed motor.

15. A method of controlling credential substrate feeding in a credential processing device comprising:

providing a credential manufacturing device comprising:

a feed motor;

a platen;

a print head;

a head lift assembly;

a substrate input comprising an input feed roller configured to feed individual cards from a card supply; and an input feed mechanism comprising an activated state, in which the input feed roller is driven by the feed motor, and a deactivated state, in which the input feed roller is not driven by the feed motor; and mechanically driving the input feed mechanism between the activated and deactivated states by moving the print head relative to the print platen using the head lift assembly.

16. The method of claim 15, wherein:

mechanically driving the input feed mechanism between the activated and deactivated states by moving the print head relative to the print platen using the head lift assembly comprises mechanically coupling and decoupling the input feed roller to the feed motor through a gear train by moving the print head relative to the print platen using the head lift assembly;

the input feed roller is mechanically coupled to the feed motor through the gear train when the print head is in a first position relative to the platen; and the gear train is mechanically decoupled from the input feed roller when the print head is in a second position relative to the platen.

17. The method of claim 15, further comprising:

placing the print head in a first position relative to the platen using the head lift assembly;

driving rotation of the input feed roller using the feed motor responsive to placing the print head in the first position;

placing the print head in a second position relative to the platen using the head lift assembly; and preventing the driving of rotation of the input feed roller using the feed motor responsive to placing the print head in the second position.

18. The method of claim 17, further comprising driving the feed motor while the print head is in the first position, and driving the feed motor when the print head is in the second positions.

* * * * *

UNITED STATES PATENT AND TRADEMARK OFFICE

CERTIFICATE OF CORRECTION

PATENT NO. : 8,730,283 B2
APPLICATION NO. : 13/496403
DATED : May 20, 2014
INVENTOR(S) : James R. Meier et al.

It is certified that error appears in the above-identified patent and that said Letters Patent is hereby corrected as shown below:

In the Claims

Column 10, line 59, delete “positions”, insert --position--.

Signed and Sealed this
Twenty-ninth Day of March, 2016

Michelle K. Lee

Michelle K. Lee
*Director of the United States Patent and Trademark Office*